US007326030B2

(12) United States Patent
Albrecht et al.

(10) Patent No.: US 7,326,030 B2
(45) Date of Patent: Feb. 5, 2008

(54) SUPPORT SYSTEM FOR A COMPOSITE AIRFOIL IN A TURBINE ENGINE

(75) Inventors: Harry A. Albrecht, Hobe Sound, FL (US); Yevgeniy Shteyman, West Palm Beach, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 228 days.

(21) Appl. No.: 11/049,241

(22) Filed: Feb. 2, 2005

(65) Prior Publication Data

US 2006/0171812 A1 Aug. 3, 2006

(51) Int. Cl.
*F01D 9/00* (2006.01)

(52) U.S. Cl. ..... 415/115; 415/210.1; 415/200

(58) Field of Classification Search ..... 415/136–139, 415/189–190, 209.2, 209.3, 209.4, 210.1, 415/115–116, 200; 29/889.21, 889.22
See application file for complete search history.

(56) References Cited

U.S. PATENT DOCUMENTS

| | | | | |
|---|---|---|---|---|
| 4,260,326 | A | 4/1981 | Scott et al. | |
| 4,907,946 | A | 3/1990 | Ciokajlo et al. | |
| 4,987,736 | A * | 1/1991 | Ciokajlo et al. | 415/138 |
| 5,076,049 | A * | 12/1991 | Von Benken et al. | 415/138 |
| 5,411,368 | A | 5/1995 | Chase et al. | |
| 5,511,940 | A | 4/1996 | Boyd | |
| 5,538,380 | A | 7/1996 | Norton et al. | |
| 5,634,767 | A | 6/1997 | Dawson | |
| 5,711,650 | A * | 1/1998 | Tibbott et al. | 415/115 |
| 6,000,906 | A | 12/1999 | Draskovich | |
| 6,164,903 | A | 12/2000 | Kouris | |
| 6,409,473 | B1 | 6/2002 | Chen et al. | |
| 6,451,416 | B1 | 9/2002 | Holowczak et al. | |
| 6,464,456 | B2 | 10/2002 | Darolia et al. | |
| 6,648,597 | B1 | 11/2003 | Widrig et al. | |
| 6,709,230 | B2 * | 3/2004 | Morrison et al. | 415/115 |
| 2002/0127097 | A1 | 9/2002 | Darolia et al. | |
| 2004/0062640 | A1 | 4/2004 | Darkins, Jr. et al. | |
| 2004/0120811 | A1 | 6/2004 | Darkins, Jr. et al. | |

FOREIGN PATENT DOCUMENTS

JP 63-223302 A * 9/1988

OTHER PUBLICATIONS

English translation of the patent JP 63-223302.*

* cited by examiner

*Primary Examiner*—Ninh H. Nguyen

(57) ABSTRACT

A turbine airfoil support system for coupling together a turbine airfoil formed from two or more components, wherein the support system is particularly suited for use with a composite airfoil. In at least one embodiment, the turbine airfoil support system may be configured to attach shrouds to both ends of an airfoil and to maintain a compressive load on those shrouds while the airfoil is positioned in a turbine engine. Application of the compressive load to the airfoil increases the airfoil's ability to withstand tensile forces encountered during turbine engine operation.

10 Claims, 4 Drawing Sheets

SUPPORT SYSTEM FOR A COMPOSITE AIRFOIL IN A TURBINE ENGINE

FIELD OF THE INVENTION

This invention is directed generally to airfoils usable in turbine engines, and more particularly to support systems for airfoils formed from two or more components.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies, to these high temperatures. As a result, turbine airfoils, such as turbine vanes and blades must be made of materials capable of withstanding such high temperatures. In addition, turbine airfoils often contain internal cooling systems for prolonging the life of the airfoils and reducing the likelihood of failure as a result of excessive temperatures.

Typically, turbine airfoils, such as turbine vanes are formed from an elongated portion having one end configured to be coupled to an outer shroud vane carrier and an opposite end configured to be movably coupled to an inner shroud. The airfoil is ordinarily composed of a leading edge, a trailing edge, a suction side, and a pressure side. The inner aspects of most turbine airfoils typically contain an intricate maze of cooling circuits forming a cooling system. The cooling circuits in the airfoils receive air from the compressor of the turbine engine and pass the air through the ends of the vane adapted to be coupled to the vane carrier. The cooling circuits often include multiple flow paths that are designed to remove heat from the turbine airfoil. At least some of the air passing through these cooling circuits is exhausted through orifices in the leading edge, trailing edge, suction side, and pressure side of the airfoil.

Composite airfoils have been developed for use in turbine engines. Composite airfoils are often constructed as laminate layers formed from high strength fibers woven into cloth that is saturated with ceramic matrix materials. The multiple laminate layers are stacked, compacted to the desired thickness, dried, and fired to achieve the desired structural properties. The laminates have desirable in-plane structural properties but significantly less strength in the through plane direction. Thus, laminates are often not capable of absorbing tensile forces that are encountered in a turbine engine environment. Rather, laminates often are damaged by tensile forces during normal engine operation. Thus, a need exists for a system for structurally supporting a composite turbine airfoil.

SUMMARY OF THE INVENTION

This invention relates to a turbine airfoil support system for supporting composite turbine airfoils in a turbine assembly. In at least one embodiment, the turbine airfoil support system may attach a turbine airfoil with platforms to shrouds such that compression forces are transmitted from the shrouds to the perimeter of the airfoil. Application of the compressive load to the airfoil at the perimeter of the airfoil increases the ability of the airfoil to accommodate tensile forces and thus, increases the life of an airfoil. By placing the perimeter of an airfoil in compression, the composite airfoil is less likely to be damaged from thermal stresses encountered during normal turbine engine operation. In particular, the compression forces applied at the perimeter of the airfoil reduce the thermal stresses on the fillets at the intersection between the airfoil and attached platforms.

The turbine airfoil may be formed from a generally elongated airfoil formed from an outer wall having a leading edge, a trailing edge, a pressure side, and a suction side. In at least one embodiment, the turbine airfoil may be formed from a composite material, such as, but not limited to ceramic, and formed from an inner core and a laminate layer joined to the inner core. The turbine airfoil may also include a first platform at a first end of the generally elongated airfoil and an outer shroud coupled to the first platform. An attachment ring may be positioned proximate to a perimeter of the first platform and be adapted to engage the outer shroud, wherein the attachment ring defines a first cavity positioned at an interface between an outer surface of the first platform and the first shroud. The turbine airfoil may also include a second platform at a second end of the generally elongated airfoil generally opposite to the first platform and an inner shroud coupled to the second platform. An attachment ring may be positioned proximate to a perimeter of the second platform and be adapted to engage the inner shroud, wherein the attachment ring defines a second cavity positioned at an interface between an inner surface of the second platform and the second shroud. The turbine airfoil may include at least one connection device for coupling the first shroud to the first end of the elongated airfoil and for coupling the second shroud to the second end of the elongated airfoil such that the first and second shrouds transmit compression forces to the elongated airfoil. The connection device may be, but is not limited to being, an elongated fastener extending through the platforms, the elongated airfoil, and the shrouds. The elongated fastener may be used in conjunction with a restrainer to attach the platforms to the shrouds and to transmit compression loads to a perimeter of the airfoil. The restrainer may be adjustable to adjust the amount of compression load applied to the platforms.

The platforms and airfoil may be configured such that when a platform is attached to a shroud, a cavity is formed at the interface between the platform and the shroud, as defined by the attachment ring. The cavity may be positioned between the first platform and an outer shroud or between the second platform and an inner shroud, or both. In at least one embodiment, the cavity may be a generally elongated cavity positioned generally orthogonal to a longitudinal axis of the airfoil and cover a substantial portion of a cross-sectional area of the airfoil except the perimeter of the airfoil. An attachment ring may extend around the cavity and be configured to transmit compressive forces from the shrouds to the platforms and to an outer perimeter of the airfoil. The attachment ring may be positioned such that the attachment ring is in line with the perimeter of the airfoil such that when compressive forces are applied to the platforms, the compressive forces are concentrated at the perimeter of the airfoil.

The connection device may be used to attach a platform of an airfoil to a shroud. When the connection device is tightened against the platform and shroud, the shroud deflects transmitting compression forces to the platforms and the perimeter of the airfoil. During operation, the connection device may expand due to thermal expansion. However, the deflection in the shroud may prevent the loss of compressive forces applied to the airfoil because the thermal expansion of the connection device may be less than that amount of deflection of the platform.

An advantage of this invention is that the turbine airfoil support system of the instant invention enables a turbine airfoil to be loaded with a compressive force at the perimeter of the airfoil that enhances the ability of the airfoil to absorb tensile forces during turbine engine operation without airfoil failure. Specifically, application of the compressive forces at the perimeter of the airfoil concentrates compressive forces at the perimeter of the airfoil and reduces the likelihood of failure at the fillets at the transition between the airfoil and the platforms. In turn, the stress reduction enables the turbine airfoil to be formed from a composite airfoil, thereby enabling the turbine airfoil to benefit from the enhanced thermal properties of the composite material.

Another advantage of this invention is that the turbine airfoil support system functions as a spring during use to prevent the compressive forces at the perimeter of the airfoil from dissipating during turbine engine operation. The shrouds deflect when loaded with a force from the connection device and act as a spring mechanism that accounts for thermal expansion of a connection device within the support system so that as the connection device expands during heating from turbine engine operation, the compressive forces are not eliminated on the elongated airfoil. Thus, the structural support given to the elongated airfoil by the turbine airfoil support structure is maintained during turbine engine operation due to the spring action of the platforms.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
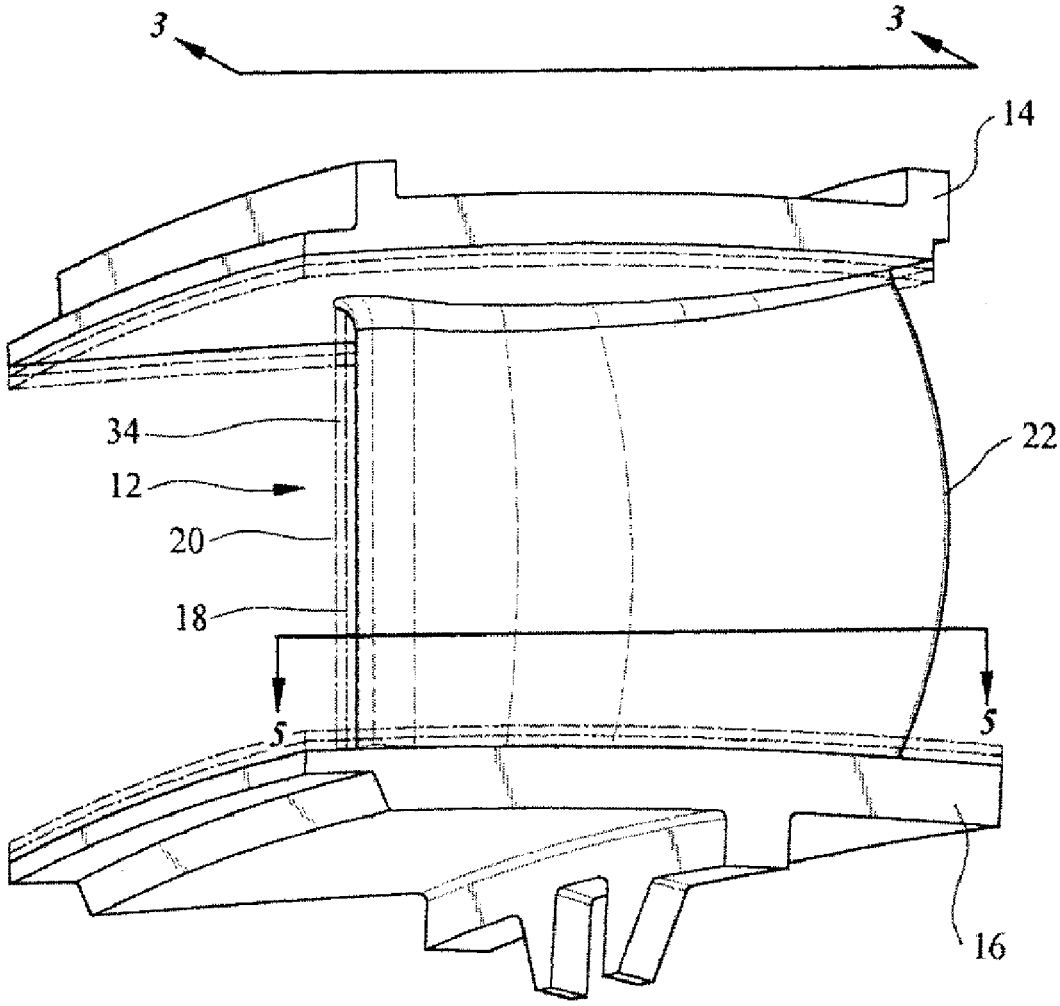
FIG. 1 is a perspective view of an airfoil having features according to the instant invention.

As shown in FIGS. 1-6, this invention is directed to a turbine airfoil support system 10 usable to provide support to composite turbine airfoils 12. In particular, the turbine airfoil support system 10 may be configured to attach a turbine airfoil 12 to adjacent outer and inner shrouds 15, 17 such that the airfoil 12 is subject to compression loads at a perimeter of the airfoil 12, thereby reducing stresses at the intersections between the airfoil 12 and having outer diameter (OD) platform 14 and an inner diameter (ID) platform 16. In at least one embodiment, the elongated airfoil 18 may be formed from a composite material. Application of compressive forces to the elongated airfoil 18 prolongs the life of the airfoil 18 by enhancing the ability of the airfoil 18 to absorb tensile forces encountered during turbine engine operation.

Figure 4:
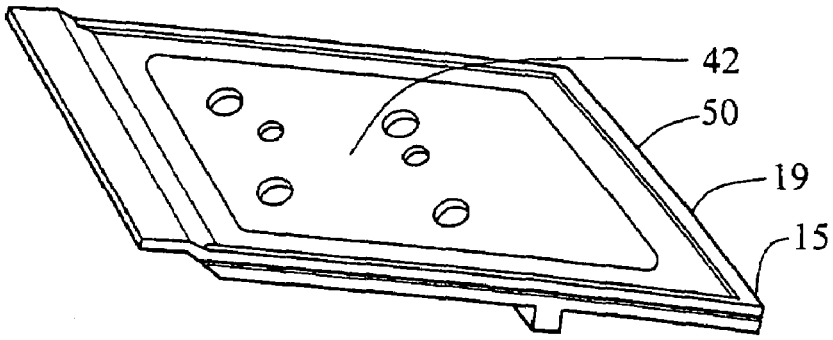
FIG. 4 is a perspective view of the platforms of the airfoil shown in FIG. 1.
Figure 5:
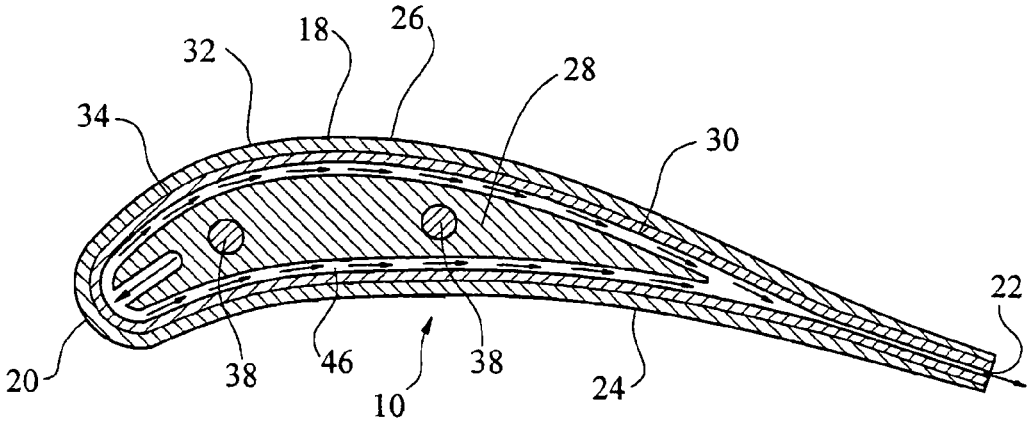
FIG. 5 is a cross-sectional view of the airfoil shown in FIG. 1 taken along section line 5-5 in FIG. 1.

As shown in FIG. 5, the elongated airfoil 18 may be formed from a leading edge 20, a trailing edge 22, a pressure side 24, and a suction side 26. In at least one embodiment, as shown in FIG. 5, the airfoil 18 may be formed from a composite airfoil 18. The composite airfoil 18 may be formed from an inner core 28, a laminate layer 30, and a thermal barrier coating 32, as shown in FIG. 5. The laminate layer 30 may be, but is not limited to being, a ceramic matrix composite material having an outer surface 34 defining the airfoil 12. The ceramic matrix composite may be any fiber reinforced ceramic matrix material or other appropriate material. The fibers and matrix material surrounding the fibers may be oxide ceramics or non-oxide ceramics, or any combination thereof. The ceramic matrix fibers may combine a matrix material with a reinforcing phase of a different composition, such as, but not limited to, mullite/silica, or of the same composition, such as, but not limited to, alumina/alumina or silicon carbide/silicon carbide. The ceramic matrix fibers may also be reinforced with plies of adjacent layers being directionally oriented to obtain the desired strength. In at least one embodiment, the laminate layer 30 may be formed from AN-720, which is available from COI Ceramics, San Diego, Calif. with mullite-alumina Nextell 720 reinforcing fibers in an alumina matrix. The thermal barrier coating 32 may be formed from the composition described in U.S. Patent No. 6,197,424 or other appropriate material. The inner core 28 may be, but is not limited to being, AN-191, which is available from Saint-Gobain, Worcester, Mass. The elongated airfoil 18 shown in FIGS. 1-5 are directed to an elongated airfoil 18 formed from a single member. However, in other embodiments, the elongated airfoil 18 may be formed from two or more components.

Figure 2:
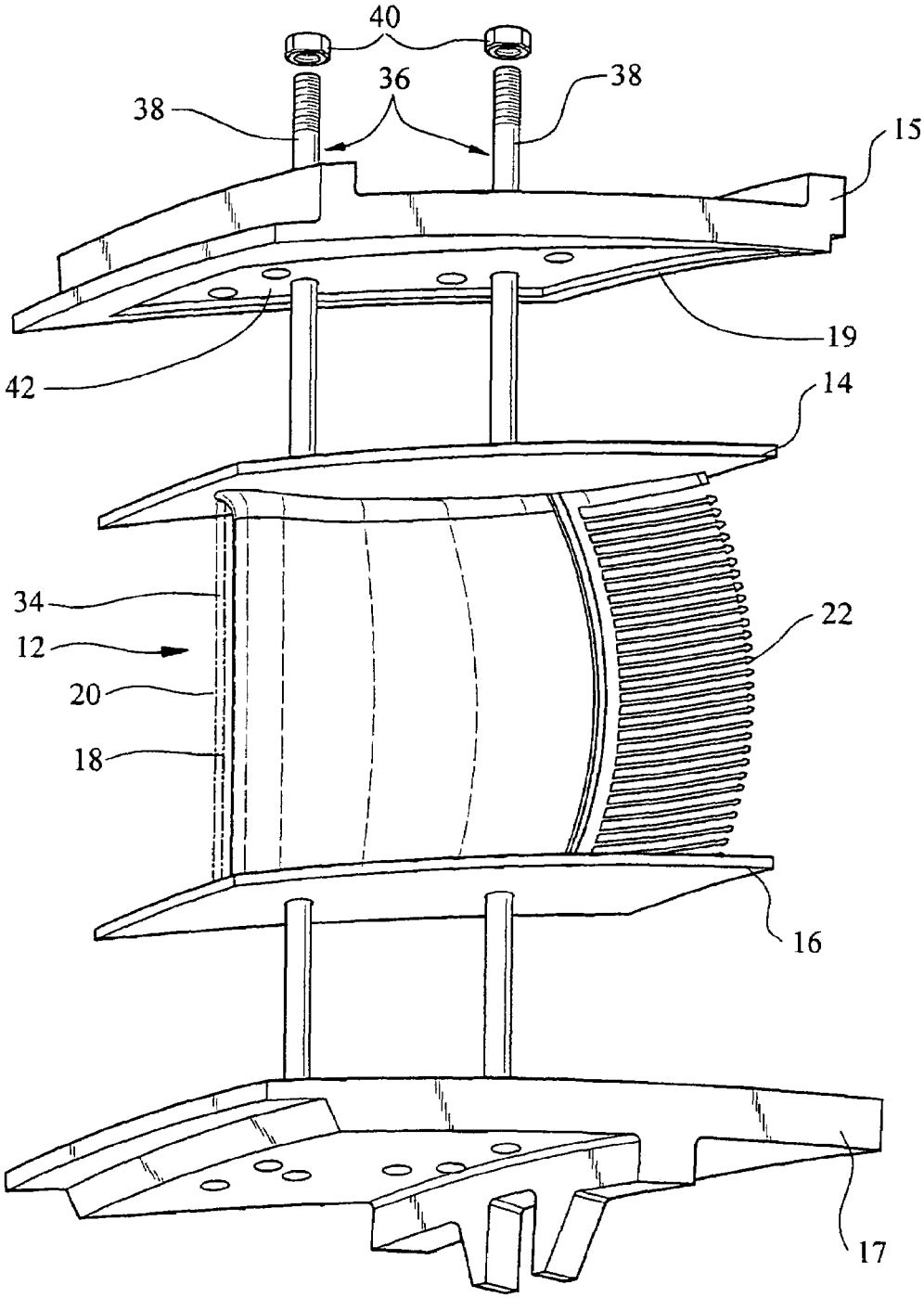
FIG. 2 is an exploded perspective view of the airfoil shown in FIG. 1.
Figure 3:
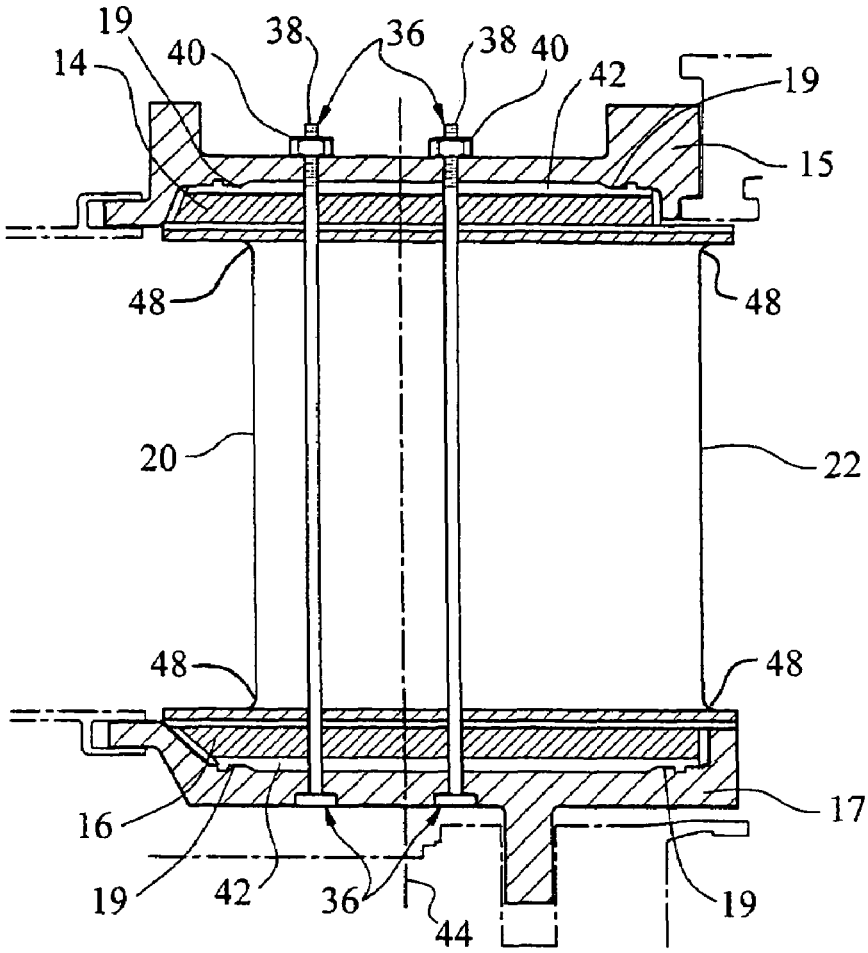
FIG. 3 is a cross-sectional view of platforms of the airfoil shown in FIG. 1 taken at detail 3-3.

As shown in FIGS. 2 and 3, the turbine airfoil support system 10 may be formed from a connection device 36 configured to attach the OD and ID platforms 14, 16 of the elongated airfoil 18 to outer and inner shrouds 15, 17, respectively. The connection device 36 may be formed from any device capable of securing the OD and ID platforms 14, 16 to the shroud 15, 17 and applying a compressive force to a perimeter of the airfoil 18 while the platforms 14, 16 remain attached thereto. In at least one embodiment, as shown in FIG. 3, the connection device 36 may be formed from at least one elongated fastener 38 extending through the outer shroud 15, the OD platform 14, the airfoil 18, the ID platform 16, and the inner shroud 17. The elongated fastener 38 may be formed from, but is not limited to, a rod, a bolt, a bar, or a shaft. One or more retainers 40 may be used to attach the platforms 14, 16 to the shrouds 15, 17.

As shown in FIG. 3, each end of the elongated fastener 38 may include a retainer 40. The retainer 40 may be, but is not limited to being, a nut or other releasable connector. In another embodiment, the elongated fastener 38 may include a flange at one end, or may be coupled to, or integrally formed with, the OD or ID platform 14, 16. The other end of the elongated fastener 38 may be configured to receive a retainer 40. In at least one embodiment, the elongated fastener 38 may include a threaded end for receiving a retainer 40, such as a nut. The retainer 40 may be tightened to apply a compressive load to the OD and ID platforms 14, 16. The retainer 40 may be adjustable, such as a nut, for varying the amount of compression load imparted onto the platforms 14, 16. The compressive load may be transmitted from the platforms 14, 16 to the airfoil 18. In at least one embodiment, as shown in FIG. 3, the turbine airfoil support system may be formed from two elongated fasteners 38 extending through the airfoil 18 and attached to the OD and ID platforms 14, 16 using retainers 40, which are nuts.

In at least one embodiment, as shown in FIG. 3, one of the OD or ID platforms 14, 16, or both, may include a cavity 42 positioned between a platform 14, 16 and the airfoil 18. The cavity 42 may have any configuration, but in at least one embodiment, the cavity 42 may be a generally elongated cavity 42 positioned generally orthogonal to a longitudinal axis 44 of the airfoil 18. The elongated cavity 42 may be used in connection with a cooling system 46 of the turbine airfoil 12. The turbine airfoil 18 may be configured to include a cooling system 46 adapted to remove heat from the airfoil 18. The cooling system 46 may be any cooling system 46 capable of adequately cooling the airfoil 12.

Figure 6:
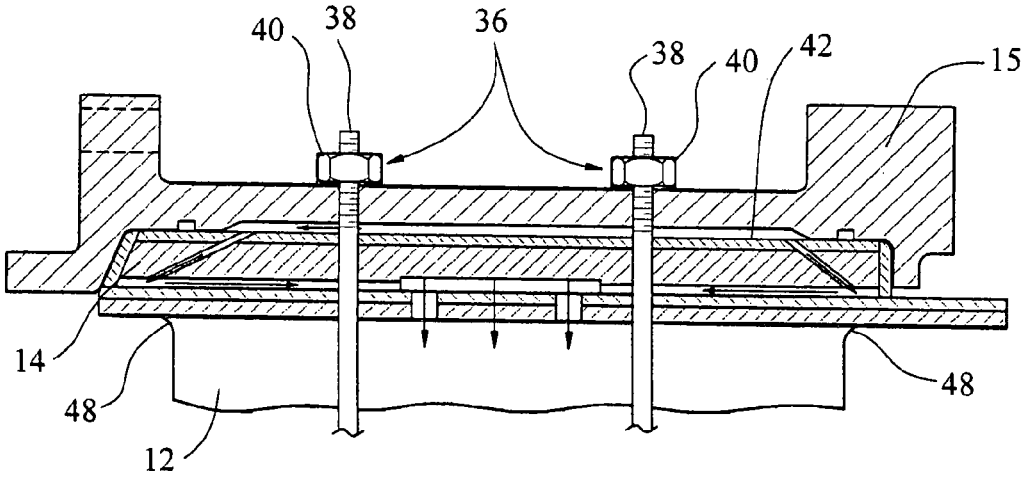
FIG. 6 is a detailed view of FIG. 3.

As shown in FIGS. 3, 4, and 6, the elongated cavity 42 may extend to form a substantial portion of the cross-sectional area of the platforms 14, 16, at an interface wherein the platforms contact shrouds 15, 17 such that compressive forces are transmitted from the shrouds 15, 17 to the perimeter of the airfoil 18. An attachment ring 50 may define the cavity 42 and be adapted to transmit compressive forces to the perimeter of the airfoil 12. As the elongated fastener 38 is tightened, a compression force is exerted onto the platforms 14, 16 from the shrouds 15, 17 through the attachment ring 50. Thus, the compressive forces are applied proximate to the perimeter 19 of the platforms 14, 16 in line with the perimeter of the airfoil. Application of the compression forces to the airfoil 18 enables the airfoil 18 to encounter tensile forces within a turbine engine without failing. In addition, application of the compressive forces to the perimeter of the airfoil 12 reduces the stresses in the fillets 48 found at the intersections between the airfoil 12 and the OD and ID platforms 14, 16. Reducing the stress at the fillets 48 increases the life of the airfoil 12.

The turbine airfoil support system 10 increases the structural integrity of the turbine airfoil 12 by applying compressive forces to the perimeter of the airfoil 12. In addition, the turbine airfoil support system is configured to place the turbine airfoil 12 under a compressive load and to maintain the compressive load on the airfoil throughout operation of a turbine engine in which the turbine airfoil 12 is mounted.

During turbine engine operation, turbine airfoils 12 are typically exposed to combustion gases at about 1,600 degrees Celsius, which causes the turbine airfoils 12 and related components to increase in temperature. This increase in temperature causes the elongated fastener 38 to lengthen. The elongated fastener 38 may be configured such that the increase in length of the fastener 38 does not cause the compression forces exerted on the airfoil 18 by the fastener 38 to be reduced below a desired threshold. The elongated fastener 38 may be tightened against the platform 14, 16 to such an extent that the platform 14, 16 may deflect, forming a spring. Additional spring action may be a result of lengthening of the elongated fastener 38 and deformation of the platforms 14, 16.

As the elongated fastener 38 is heated during turbine engine operation and expands, the amount of deflection is reduced. However, the turbine airfoil support system 10 may be designed such that the platforms 14, 16 do not return to a non-deflected position, thereby retaining the airfoil 18 under compressive forces. A diameter of the elongated fastener 38 and thicknesses of the outer and inner shrouds 15, 17 may be sized such that together, the elongated fastener 38 and the outer and inner shrouds 15, 17 provide the proper spring load to maintain both the compressive load and to accommodate thermal mismatch between the rods and the composite airfoil 18. The turbine airfoil support system 10 may be assembled by attaching a connection device 36 to an outer shroud 15 at a first end of the generally elongated airfoil 18 and to an inner shroud 17 at a second end of the generally elongated airfoil 18 such that the connection device 36 extends through the outer shroud 15, the OD platform 14, the airfoil 12, the ID platform 16, and the inner shroud 17. The connection device 36 may be actuated such that the outer shroud 15 is coupled to the first end of the elongated airfoil 18 and the inner shroud 17 is coupled to the second end of the elongated airfoil 18 such that the first and second platforms 14, 16 transmit compression forces to the elongated airfoil 18.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated airfoil formed from an outer wall having a leading edge, a trailing edge, a pressure side, and a suction side;

a first platform at a first end of the generally elongated airfoil;

an outer shroud coupled to the first platform;

an attachment ring positioned proximate to a perimeter of the first platform adapted to engage the outer shroud, wherein the attachment ring defines a first cavity positioned at an interface between an outer surface of the first platform and the outer shroud;

a second platform at a second end of the generally elongated airfoil generally opposite to the first platform;

an inner shroud coupled to the second platform;

an attachment ring positioned proximate to a perimeter of the second platform adapted to engage the inner shroud, wherein the attachment ring defines a second cavity positioned at an interface between an outer surface of the second platform and the inner shroud; and at least one connection device for coupling the outer shroud to the first end of the elongated airfoil and for coupling the inner shroud to the second end of the elongated airfoil with the respective attachment rings being in line with respective perimeter ends of the elongated airfoil such that the inner and outer shrouds transmit compression forces that are concentrated at a perimeter of the elongated airfoil.

2. The turbine airfoil of claim 1, wherein the connection device is adjustable such that the compression forces imparted on the elongated airfoil by outer and inner shrouds are variable.

3. The turbine airfoil of claim 2, wherein the connection device includes at least one retainer releasably attached to the connection device for applying a compressive force to the elongated airfoil via the outer and inner shrouds.

4. The turbine airfoil of claim 1, wherein the generally elongated airfoil is comprised of an inner core and a ceramic matrix composite laminate layer joined to the inner core.

5. The turbine airfoil of claim 1, wherein the connection device comprises at least two rods extending through the elongated airfoil, through the first and second platforms of the generally elongated airfoil, and into the inner and outer shrouds, thereby enabling the shrouds to transmit compression forces to the elongated airfoil.

6. A turbine airfoil, comprising:

a generally elongated airfoil formed from an outer wall having a leading edge, a trailing edge, a pressure side, and a suction side;

a first platform attached by a fillet along a perimeter at a first end of the generally elongated airfoil;

an outer shroud coupled to the first platform;

a first attachment ring positioned proximate to a perimeter of the first platform in line with the perimeter of the first platform and adapted to engage the outer shroud, wherein the attachment ring defines a first cavity positioned at a perimeter interface between an outer surface of the first platform and the outer shroud;

a second platform attached by a fillet along a perimeter at a second end of the generally elongated airfoil generally opposite to the first platform;

an inner shroud coupled to the second platform;

a second attachment ring positioned proximate to a perimeter of the second platform in line with the perimeter of the second platform and adapted to engage the inner shroud, wherein the attachment ring defines a second cavity positioned at an interface between an outer surface of the second platform and the inner shroud;

at least one connection device for coupling the outer shroud to the first end of the elongated airfoil and for coupling the second shroud to the second end of the elongated airfoil such that the inner and outer shroud transmit compression forces through the respective attachment rings in line with the perimeter of the elongated airfoil, and a cooling system in the elongated airfoil comprising an internal cooling channel of the airfoil and the first and second cavities.

7. A turbine apparatus comprising:

an airfoil section;

a platform joined by a fillet along a perimeter at an end of the airfoil section;

a shroud comprising a perimeter attachment ring disposed against the platform opposed the airfoil section and defining a cavity there between;

a connection device urging the shroud and airfoil section together with a compressive force transmitted through the attachment ring to the platform; and the perimeter attachment ring being in line with the perimeter of the airfoil so that the compressive force is concentrated at the perimeter of the airfoil section and is effective to reduce tensile stress in the fillet.

8. The turbine apparatus of claim 7, further comprising a cooling passage formed in the airfoil section, the cooling passage and cavity comprising part of a cooling system for the turbine apparatus.

9. The turbine apparatus of claim 7, further comprising;

the connection device urging the shroud to a deflected position in response to the compressive force;

expansion of the connection device during an increase in temperature of the turbine apparatus reducing the deflection of the shroud; and wherein the turbine apparatus is designed so that the shroud does not return to a non-deflected position at an operating temperature of the turbine apparatus, thereby retaining the airfoil section under compression.

10. The turbine apparatus of claim 7, wherein the airfoil section comprises a ceramic matrix composite laminate layer comprising an outer surface defining an airfoil shape.

* * * * *